US006212986B1

(12) United States Patent
Decker et al.

(10) Patent No.: US 6,212,986 B1
(45) Date of Patent: Apr. 10, 2001

(54) RAPID BREAKDOWN EXCISION TOOL (RABET)

(75) Inventors: Mark W. Decker; Therese M. Atienzamoore; Robert L. Gerber, all of Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/206,270

(22) Filed: Dec. 4, 1998

(51) Int. Cl.[7] ..... F42B 33/06

(52) U.S. Cl. ..... 86/49; 82/1.11; 82/101; 83/54; 83/436.7; 83/886; 89/1.13

(58) Field of Search ..... 86/1.1, 49, 50; 89/1.13; 82/1.11, 101, 117; 83/54, 436.7, 773, 886; 102/293

(56) References Cited

U.S. PATENT DOCUMENTS

| | | | | |
|---|---|---|---|---|
| 2,449,059 | * | 9/1948 | Costello | 86/49 |
| 2,517,106 | * | 8/1950 | Hamlin | 86/49 |
| 3,906,821 | * | 9/1975 | Schultz, Jr. | 82/101 |
| 5,027,681 | * | 7/1991 | Hyvärinen | 82/101 |
| 5,295,428 | * | 3/1994 | Heitmann et al. | 86/49 |
| 5,353,676 | * | 10/1994 | King et al. | 86/50 |

FOREIGN PATENT DOCUMENTS

| | | | | |
|---|---|---|---|---|
| 2515854 | * | 10/1976 | (DE) | 83/54 |
| 2639 | * | of 0000 | (GB) | 86/49 |

* cited by examiner

*Primary Examiner*—Harold J. Tudor
(74) *Attorney, Agent, or Firm*—Earl H. Baugher, Jr.; Gregory M. Bokar

(57) ABSTRACT

Provided is an automated case cutting device that may be remotely controlled to rotate and cut an outer case of an object. It can be applied to the disassembly and disposal, testing, or inspection of munitions. In one application, the device cradles a generally cylindrical munition of a length much greater than its diameter on two rollers attached to a bed or plate comprising a support frame. One of the rollers is rotated by a transmission mechanism powered by an electrical motor, while the other roller may also be turned by the same transmission mechanism via a sprocket and chain set. The munition may be further held in place by one or a set of holding rollers attached to a frame hinged to the support frame, so that the holding roller(s) swing onto the top of the munition after the munition is placed on the cradling rollers. The holding roller(s) may also be turned via a second sprocket and chain set, driven off the same drive shaft as the first roller. This arrangement, together with end pads affixed between the support frame and each end of the munition, provides a secure fixture for holding the munition as it is rotated on the rollers. The rollers also have a covering that provides greater friction between the rollers and the munition, thus insuring a smooth rotation on the rollers. This covering can be applied to the roller to provide slots for fitting the device to any protuberances from the otherwise cylindrical case of the munition. A cutting fixture, attached to the side of the device's support frame, is moved inward toward the munition as it is turned in the fixture, cutting through the circumference of the munition's case in at least one location in one to two minutes. The whole procedure may be controlled remotely to insure safety of operating personnel. A method for disassembling the munition using the device is also disclosed.

20 Claims, 4 Drawing Sheets

RAPID BREAKDOWN EXCISION TOOL (RABET)

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to a case cutting device. More particularly, the present invention is a cutting device for munitions. Most particularly, the cutting device remotely rotates and cuts munitions for disassembly.

2. Brief Description of the Related Art

Munitions handling is a tedious and hazardous endeavor. With current demilitarization, there has developed a need for disposing of munitions in an efficient way. However, handling and cutting munitions during disassembly generally require extended periods of time for personnel to perform the disassembly. Munitions generally possess three significant sections: the warhead and fuse, the control and guidance electronics, and the propellant. Disassembly and salvage of these munitions may require these sections to be separated.

In addition to demilitarization, munitions may be disassembled to discontinue weapon service due to aging, for training purposes, and/or for analysis. Several aging weapon systems are being placed out of service, including the Shillelagh anti-tank weapon system of 1960's vintage. Aging weapon systems may present problems of disassembly, as the components of the munitions may be slightly corrupted. Currently, hand tools are used to disassemble munitions, requiring on average approximately 15 to 30 minutes per missile.

Efficient devices and methods for the disassembly of munitions do not exist. There is a need in the art to provide a device and an improved method for disassembling munitions that allows the efficient and safe disassembly of the munitions.

SUMMARY OF THE INVENTION

The present invention comprises a device, with particular application to munition disassembly, comprising a case cutting first frame member and a second frame member, the first frame being fixed in a stationary position having the second frame member movably connected thereto sufficient to permit an open and closed position of the second frame member to the first frame member; a first and second horizontally level roller shafts, the first and second roller shafts rotationally attached to the first frame member and capable of a side-by-side configuration at a distance less than the width of the munition; at least a third roller shaft rotationally attached to the second frame member located above and optionally horizontally between the first and second roller shafts in the closed position, wherein the third roller shaft vertically secures the munition on top and between the first and second roller shafts; a plurality of roller coverings circumferentially attached to the first, second and third roller shafts and positioned in relation to each other capable of supporting and securing the munition on top of and between the first and second roller shafts, wherein the munition is capable of being rotated; a first end pad capable of engaging a first end of the munition and fixing the longitudinal positioning of the munition on the plurality of roller coverings, and a second end pad capable of engaging a second end of the munition and securing the munition in the fixed position; means for cutting the munition effective to sever sections of the munition; and, means for rotating the munition effective to circumferentially rotate the munition on top of and between the first and second roller shaft.

The present invention further comprises a method for cutting cases, with particular application to munition disassembly, comprising the steps of providing a case cutting device comprising a first frame member and a second frame member, the first frame being fixed in a stationary position having the second frame member movably connected thereto sufficient to permit an open and closed position of the second frame member to the first frame member, a first and second horizontally level roller shafts, the first and second roller shafts rotationally attached to the first frame member and capable of a side-by-side configuration at a distance less than the width of the munition, at least a third roller shaft rotationally attached to the second frame member located above and optionally horizontally between the first and second roller shafts in the closed position, wherein the third roller shaft vertically secures the munition on top and between the first and second roller shafts, a plurality of roller coverings circumferentially attached to the first, second and third roller shafts and positioned in relation to each other capable of supporting and securing the munition on top of and between the first and second roller shafts, wherein the munition is capable of being rotated, a first end pad capable of engaging a first end of the munition and fixing the longitudinal positioning of the munition on the plurality of roller coverings, and a second end pad capable of engaging a second end of the munition and securing the munition in the fixed position, means for cutting the munition effective to sever sections of the munition, and, means for rotating the munition effective to circumferentially rotate the munition on top of and between the first and second roller shaft; placing munition on top and between the first and second roller shafts; securing the munition on top and between the first and second roller shafts with at least the third roller shaft; engaging the means for cutting with the munition; and, rotating the munition, wherein the munition is circumferentially rotated and severed.

DETAILED DESCRIPTION OF THE PREFERRED EMBODIMENT

The present invention is a cutting device and method for the disassembly of munitions. The present invention provides for the safe, effective, and efficient cutting of the case of munitions, for destruction, training or analysis of the munitions. The device and method may be used in the disassembly of several sizes and weights of munitions.

Figure 1:
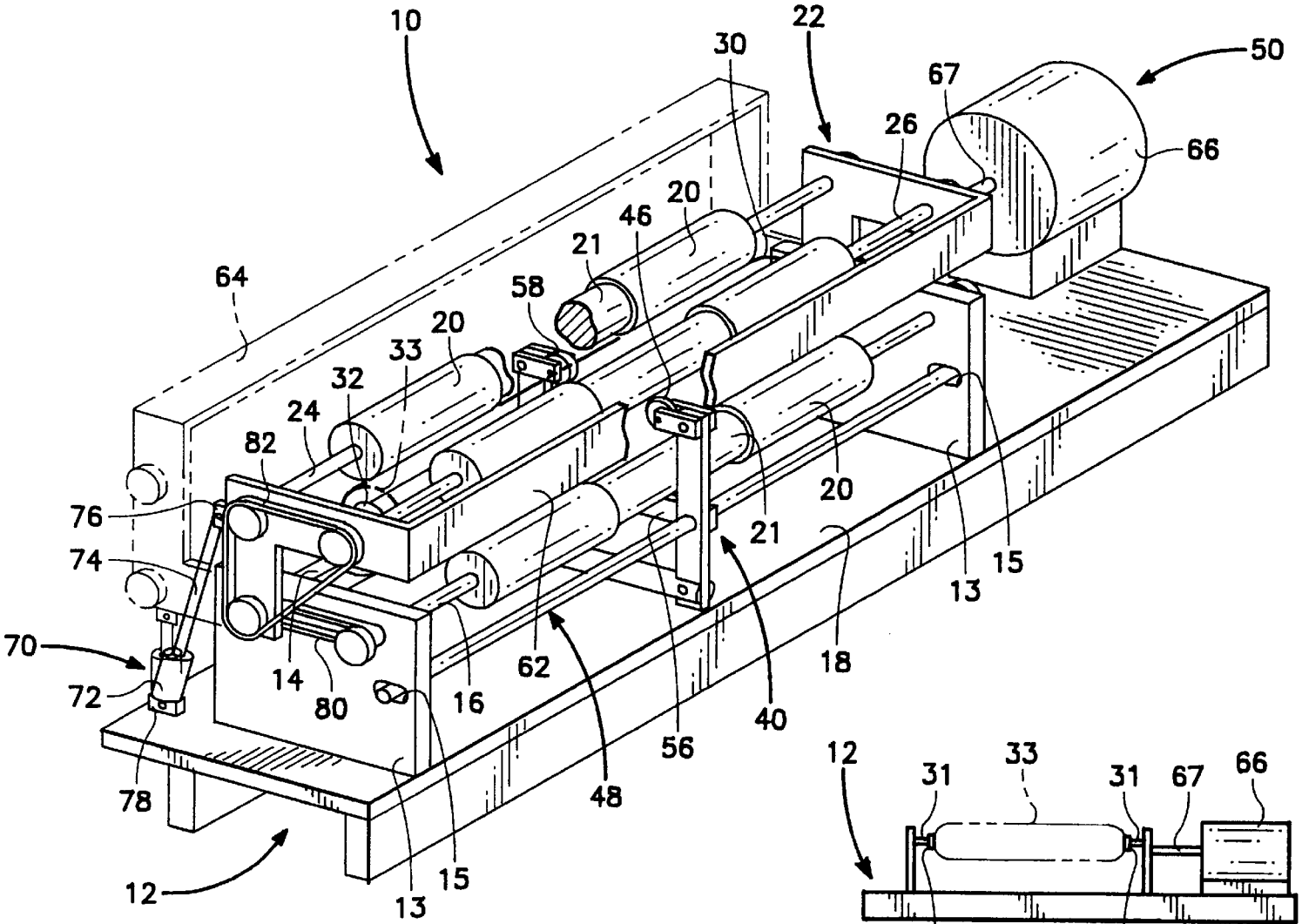
FIG. 1 is a prospective view of a preferred embodiment of the present invention showing a frame member in an open and closed position.

FIG. 1 is a prospective view of a preferred embodiment of the present invention. Typically, the case cutting device 10 may be used to separate the case of a fifty pound Shillelagh anti-tank weapon that is approximately six inches in diameter and four feet long. Additionally, the case cutting device 10 may be used to separate the case of significantly larger missiles, such as commercial propulsion systems that weigh several hundred tons. Different munitions have varying types of cases, ranging from a thin aluminum skin to a thick composite skin. Other munitions that may have their cases separated by the present invention include Sidewinder, HARM, Harpoon, 2.75" rocket, and other like munitions.

Referring to FIG. 1, the case cutting device 10 comprises a stationary first frame member 12 with a movable second frame member 22 attached thereto. The first 12 and second 22 frame members support, either directly or indirectly, functional component parts of the case cutting device 10. The component parts include a first 14 and second 16 horizontally level roller shafts attached to the first frame member 12. A third roller shaft 24, preferably with a fourth roller shaft 26, are attached to the second frame member 22, and located, when in a closed position, above the first 14 and second 16 roller shafts. A plurality of roller coverings 20 are circumferentially attached to the roller shafts 14, 16, 24, and 26. A first 30 and second 32 end pad are positioned on the first frame member 12 at opposite ends of the munition 33. A means for cutting 40 the munition 33 mounted along each side of the munition 33, and a means for rotating 50 the munition 33 is located at one of the ends on first frame member of the first frame member 12.

As seen in FIG. 1, the first 12 and second 22 frame members provide support for the component parts of the case cutting device 10, and allow the component parts to interact in a logical and precise manner. The first frame member 12 may be seen as "blocking" the munition, or containing the munition in a confined area, when seen in conjunction with the component parts of the case cutting device 10. Although the first frame member 12 may be at any functional height, preferably the first frame member 12 raises the component parts of the case cutting device 10 to a convenient level for personnel to work on a munition 33 placed therein. A bed plate or table section 18 may be attached to the first frame member 12 as a structural part of the first frame member 12, ensuring the geometry of the case cutting device 10. The first frame member 12 may be of any structurally solid material, such as wood, aluminum, steel, structural plastics, and the like, that provides sufficient holding of the component parts in position. In addition to supporting the weight and size of the component parts, the first frame member 12 supports the munition 33 before, during and after placement within the first frame member 12, in a manner facilitating the rotating and cutting of the munition 33. Preferably the first frame member 12 comprises a composition of aluminum.

The first frame member 12 of the case cutting device 10 has the first roller shaft 14 and second roller shaft 16 rotationally attached thereto. The first roller shaft 14 and a second roller shaft 16 are horizontally level in relation to each other. The roller shafts 14, 16 may be longitudinally fixed, but are preferably laterally adjustable in relation to each other, being capable of side-by-side placement for placing munitions thereon. As either fixed or adjustable, the roller shafts 14,16 form a side-by-side configuration at a distance that is less than the width of the munition 33 to be rotated and cut. This allows the first 14 and second 16 roller shafts to cradle the munition 33 on top of and between the two roller shafts 14, 16. The first 14 and second 16 roller shafts preferably are supported on vertical extensions 13 of the first frame member 12. Preferably the first 14 and second 16 roller shafts are raised above the ground level for ease of loading the munition 33 thereon, preferable from about 15 inches to about 40 inches, more preferably from about 20 inches to about 35 inches, and most preferably from about 15 inches to about 20 inches above the ground or supporting table top (not separately shown).

The second frame member 22 is movably attached to the first frame member 12, preferably in a hinge-like manner. Other types of movement non-exclusively include gear locking, sliding, clamping, and other like manners that permit the movement of the second frame member 22 in relation to the first frame member 12. The second frame member 22 moves between an open 64 and closed 62 position or configuration. An open position 64 allows the loading of the munition onto the first 14 and second 16 roller shafts mounted on the first frame member 12, or the unloading therefrom. A closed position 62 holds the munition 33 in position on the first 14 and second 16 roller shafts sufficiently to permit rotation and cutting of the munition 33.

The third roller shaft 24 is rotationally fixed to the case cutting device 10, and located above and optionally between the first 14 and second 16 roller shafts. The third roller shaft 24 is fixed to and supported by the second frame member 22 in a manner that permits the third roller shaft 24 to sufficiently move away from the first 14 and second 16 roller shafts when the second frame member 22 is moved to the open position 64. The distance between the third roller shaft 24, and the first 14 and second 16 roller shafts may primarily result from the movement of the second frame member 22 in relation to the first frame member 12. The third roller shaft 24 is capable of some degree of vertical movement with respect to the first frame member 12, allowing the third roller shaft 24 to be distanced from the first 14 and second 16 roller shafts in an open position 64 for loading a munition 33 onto the case cutting device 10. After the munition 33 is loaded, the second frame member 22, with the third roller shaft 24, is lowered and placed on top of the munition 33 cradled on the first 14 and second 16 roller shafts. This vertically fixes and secures the munition 33 on top and between the first 14 and second 16 roller shafts and below the third roller shaft 24. The case cutting device 10 may further comprises a fourth roller shaft 26, and other additional roller shafts (not separately shown) that aid in securing the munition 33 in the case cutting device 10. When the number of roller shafts 14, 16, 24, 26 does not exceed three, the third roller shaft 24 is preferably placed on top of the munition 33 such that it is vertically above the mid-point between the first 14 and second 16 roller shafts. When the number of roller shafts is four, the third 24 and fourth 26 roller shafts are located above the first 14 and second 16 roller shafts, respectively, in order to fix and secure the munition 33 in a cradled position in the most effective manner. When more than four roller shafts 14, 16, 24, 26 are present, the roller shafts 14, 16, 24,26 are located about the munition 33 in a manner that best secures the munition 33 in a cradled position, with the location of the shafts 14, 16, 24, 26 determinable by one skilled in the art. Preferably there are from three or more roller shafts, more preferably from four or more roller shafts 14, 16, 24, 26, and most preferably four roller shafts 14, 16, 24, 26. The roller shafts 14, 16, 24, and 26 may comprise any length that facilitates the cradling of a munition 33, generally being of similar length to, or slightly shorter or longer than, the length of the munition 33 being disassembled. Preferably the length of the roller shafts 14, 16, 24, 26 is from about two feet to about sixty feet, more preferably from about three feet to about twenty feet, still more preferably from about four feet to about ten feet, and most preferably from about four feet to about five feet. The diameter of the roller shafts 14, 16, 24, 26 is determinable by those skilled in the art to functionally rotate the munition 33, generally being about ½ the diameter of the munition 33 to be cut, and may be such diameter as from about 12 inch to about 30 inches, more preferably from about 1 inch to about 5 inches, and most preferably from about 2½ inches to about 3 inches.

A plurality of roller coverings 20 are circumferentially attached to the roller shafts 14, 16, 24, and 26. These roller coverings 20 are used to cushion the munition 33, when loaded within the first frame member 12, and to frictionally engage with the munition 33 to rotate the munition 33. Preferably, the plurality of roller coverings 20 are similarly distributed along the length of the different roller shafts 14, 16, 24, 26. The roller coverings 20 are positioned along the length of the roller shaft 14, 16, 24, 26 in relation to each other so that munition 33 is properly supported and secured while allowing areas of the munition 33, when desired, to remain free of contact with the roller coverings 20 at gaps 21 between the roller coverings 20. Munition 33 areas remaining free of contact with the roller coverings 20 may non-exclusively include cut areas, areas having external protrusions from the munition case, and other such like areas, with the determination of which areas remaining free of the roller coverings 20 being determinable by those skilled in the art. Although these gaps 21 generally exist between the roller coverings 20 on a given roller shaft 14, 16, 24, 26, the roller coverings 20 may also comprise a continuous layer along any roller shaft 14, 16, 24, 26, when desired. The roller coverings 20 may comprise any padding for this purpose that properly functions as a frictional area for contact with the munition 33 and that is usably placed on and along a rotating roller shaft. Preferably, the roller coverings 20 comprise a polymer composition, more preferably the polymer composition comprises polyurethane. The thickness of the roller coverings 20 preferably is from about ¼ inch to about 2 inches, more preferably from about ¼ inch to about ¼ inch, and most preferably from about ¼ inch to about ¾ inch. The diameter of the covered shafts 14, 16, 24, 26 is from about ¾ inch to about 12 inches, more preferably from about 1½ inches to about 5 inches, and most preferably from about 2½ inches to about 3½ inches. Roller coverings 20 may be an integral part of the roller shafts 14, 16, 24, 26 when the roller shaft 14, 16, 24, 26 provides a cushion support and frictional engagement of a munition 33. Adapter rings may be used on the munition 33. Adapter rings are hoops that are circumferentially attached to the munition 33 prior to loading the munition 33 onto the case cutting device 10, and may be used in conjunction with roller coverings 20 to aid in frictional rotation of the munition 33. Adapter rings may be used to increase the diameter of the munition 33 to a diameter that a particular case cutting device 10 was designed to operate.

Figure 1A:
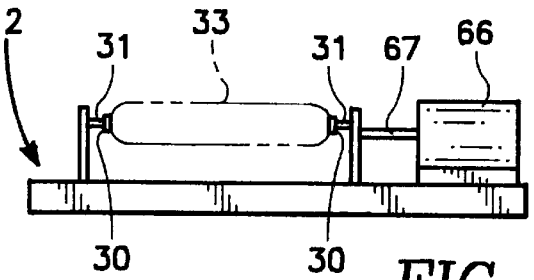
FIG. 1A is a side view of the end pads shown in FIG. 1.

As seen in FIGS. 1 and 1A, at the head of the munition 33, when placed in the case cutting device 10, a first end pad 30 is attached to the first frame member 12. The first end pad 30 engages the top end of the munition 33, thereby fixing at one end of munition disassembly device 10 the longitudinal positioning of the munition on the plurality of roller coverings 20. A second end pad 32 that also is attached to the first frame member 12 engages the bottom end of the munition 33, thereby securing the munition 33 in the fixed longitudinal position acquired by the first end pad 30. The fixed longitudinal position precisely fixes the munition 33 relative to the cutting means 40. The first 30 and second 32 end pads are connected to first frame member 12, such as with threaded rods 31 that are longitudinally screwably adjustable and secured with locking nuts (not separately shown). As such, munitions 33 of various lengths may be accommodated by the case cutting device 10. The first 30 and second 32 end pads are preferably capable of rotation with the rotational movement of the munition 33, more preferably comprising rotation bearings (not separately shown) riding on the rods 30.

Figure 2:
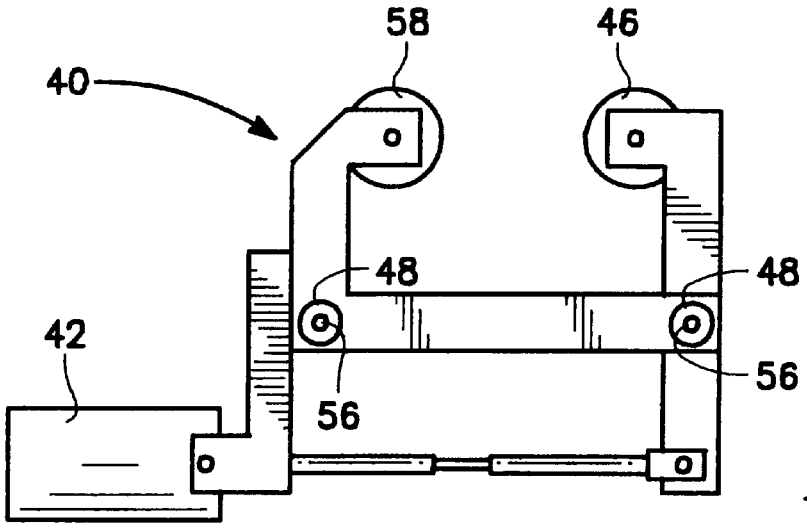
FIGS. 2, 2A and 2B are side views of preferred cutting means for the present invention; and, FIG. 3 is a schematic of a preferred embodiment of actuators, controls, connections, and the control panel of the present invention.
Figure 2A:
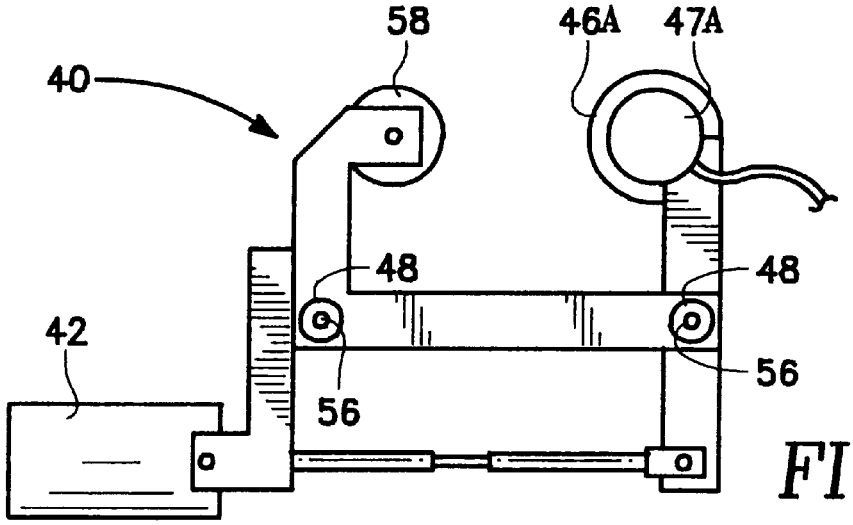
Figure 2B:
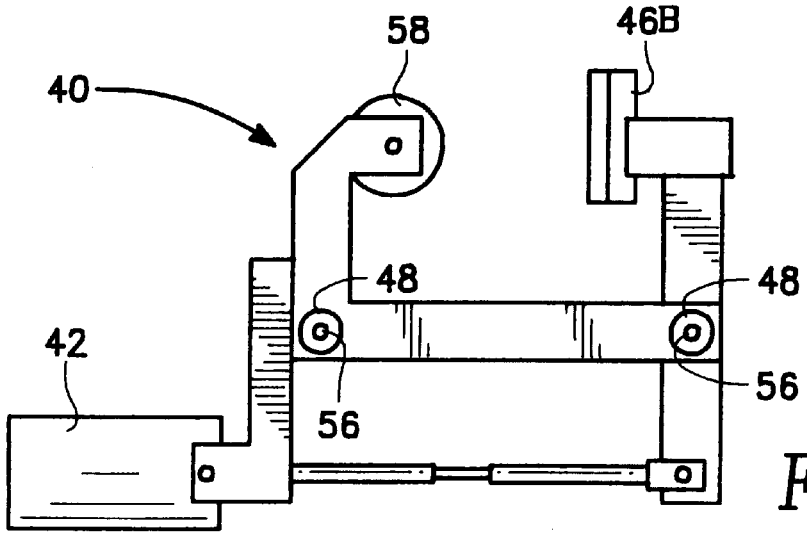

As further seen in FIG. 1 and in greater detail in FIG. 2, the means for cutting 40 the munition 33 effective to cut or sever sections of the munition 33 may be attached to floating cutter support rods 48 which are positionally fixed along the sides of the first frame member 12. The cutting means 40 may be adjustable for various types and sizes of munitions 33. Preferably the means for cutting 40 includes a cutting blade 46 connected to a closing device 42. More preferably, the closing device 42 is capable of adjusting the cutting blade 46 to various cutting depths on the munitions 33, and most preferably the closing device has a depth sensitive cut capability, providing for a predetermined finite cutting depth. This minimizes damage to internal components of the munition 33 for later inspection and analysis. The closing device 42 may comprise a cylinder (not separately shown) and piston rod (not separately shown) for engaging or releasing the cutting blade 46 from a proximate position to the munition 33. On the side opposite the cutting blade 46, the closing device 42 may comprise a flat wheel 58, or other similar device for bracing the munition 33 within the closing device 42. The flat wheel 58 exerts enough horizontal resistance to the cutting blade 46 for the cutting blade 46 to engage and cut the munition 33. The flat wheel 58 is preferably supported with a pin mechanism that allows free rotational movement of the flat wheel 58. When desired for a particular application, the flat wheel 58 may comprise a second cutting blade (not separately shown), with the applicability of using a second cutting blade for a given purpose determinable by those skilled in the art. Activation of the cylinder and piston rod is preferably by remote automatic means (not separately shown), such as a hydraulic or pneumatic switch (not separately shown). Preferably, the cutting depth includes a distance of the sum of the thickness of the munitions skin, plus a depth of from about 1/32 inch to about ½ inch, more preferably from about 1/20 inch to about ½ inch, and most preferably from about 1/16 inch to about ½ inch.

Types of cutting blades 46 that exemplify the present invention, non-exclusively include cutters such as saw blades 46A powered by air motors 47A, hydraulic motors 47B, electric motors, cutting wheels 46, straight knife-bladed assemblies 46B, cutting edges incorporating diamond bits, tungsten carbide tips, and the like (not separately shown), and combinations thereof. When saw blades 46A are used, air motors 47A and/or hydraulic motors 47B are preferred to reduce the explosion hazard. Particular types of cutting blades 46 may be used for different types of material to be cut, with the type of cutting blade 46 being determinable by those skilled in the art for a given material. Cutting blades 46 may be varied or interchanged to cut different thickness and case compositions, such as aluminum, steel, KEVLAR® and similar coverings thick. Thickness of the munition's skin typically may range from about one inch or less, about ¼ inch to about one-thirtysecond inch, or about three-thirtyseconds inch to about one-thirtysecond inch. A cutting wheel 46 is preferred for minimizing chips from cutting.

The means for cutting 40 may further comprise floating cutter support rods 48 that are transversely, slidably attached to the vertical support 13 of the first frame member 12. Slots 15 within the vertical support 13 on the first frame member 12 allow self-alignment transversely with the width of the munitions 33. The floating cutter support rods 48 allow the longitudinal position of the cutting means 40 to be changed along the length of the munition 33 to a desired position. Locking collars 56 are preferably used with the floating cutter support rods 48 to ensure the steady placement of the cutting blade 46 at a given location along the side of the munition 33.

In a preferred embodiment, the present invention may comprise a second means (not separately shown) for cutting, preferably with the second means being separately engagable from the first means 40. This allows multiple cuts along the length of the munition 33 at one time while the munition 33 is being rotated. Preferably the case cutting device 10 comprises two or more means for cutting (not separately shown), with each means having two opposing cutting wheels (not separately shown) located at different locations along the length of the munition 33 that sever the outer skin of the rotating munition 33.

FIG. 1 further shows the case cutting device 10 comprising a means for rotating 50 the munition 33, with the munition 33 circumferentially rotated on top of and between the first 14 and second 16 roller shaft. The rotating means 50 rotates either the first 14 or second 16 roller shafts, or both. Preferably, the means for rotating 50 rotates the first roller shaft 14, with the first roller shaft 14 connected to the second roller shaft 16 through a lower chain and sprocket drive set 80. The lower chain and sprocket drive set 80 imparts rotational force from the first roller shaft 14 to the second roller shaft 16, driving both shafts 14, 16 in the same direction and at the same speed. Additionally, an upper chain and sprocket drive set 82 connects the first roller shaft 14 with the third 24 and fourth 26 roller shafts, driving the third 24 and fourth 26 roller shafts in the same direction and at the same speed as the first roller shaft 14. The means for rotating 50 preferably includes a motor 66 attached to a power supply (not separately shown) for rotationally powering at least the first roller shaft 14, thereby rotating the munition 33 located in the munition disassembly device 10. The means for rotating 50 further comprises a connection 67 between the motor 66 with the first roller shaft 14. The rotating means 50 is sufficiently powered through the motor 66 to effectively rotate the munition 33 cradled on the first 14 and second 16 roller shafts while the cutting means 40 is engaged. The rotating means 50 preferably imparts a munition 33 rotation rate of from about 5 rpm (revolutions per minute) to about 40 rpm, more preferably from about 10 rpm to about 30 rpm, and most preferably from about 10 rpm to about 15 rpm. Rotation rates of greater than 40 rpm are possible, but the efficiency and safety of the operation significantly decrease. For example, the rotating means 50 may be a 208 Volts AC, 3 phase, ½ horsepower (HP) motor 66, and an input to a 87.5:1 gear reducer (not separately shown) that drives a misalignment coupling 67 that is connected to the first roller shaft 14.

FIG. 1 further shows the preferred mechanism for placing the first 12 and second 22 frame members in an open position 64 to receive and extract a munition 33, and in a closed position 62 for cutting the received munition 33. Preferably, the first 12 and second 22 frame members are connected in a hinge-like manner, with a roller clamping mechanism 70 comprising a powering mechanism, preferably having a pneumatic or hydraulic fluid system, such as a pneumatic clamping cylinder 72 having a piston rod 74 that is used for moving the movable second frame member 22 in relation to the stationary first frame member 12. The pneumatic clamping cylinder 72 has a pinned connection 78 fixed to the first frame member 12 on the end of the pneumatic clamping cylinder 72 opposite the piston rod 74. The piston rod 74 has a pinned connection 76 fixed to the second frame member 22 on the end opposite the pneumatic clamping cylinder 72. As the pneumatic clamping cylinder 72 extends the piston rod 74, the piston rod 74 imparts a force on the second frame member 22 at connection 76 that forces the second frame member 22 to swing onto the first frame member 12 to a closed position 62. When this closing occurs after the munition 33 has been loaded within the first frame member 12, the munition is encased between the roller shafts 14, 16, 24, and 26.

Different types of munitions contain different types of fuses (not separately shown). Certain munitions possess fuses that arm the weapon with the longitudinal acceleration of the munition after it is fired from a weapon launcher. Other types of munitions arm the fuse with the rotational motion of the munition after firing. Accordingly, munitions that arm with rotational movement are not well suited for disassembly within the case cutting device 10, as that type of munition could possibly become armed during rotation of the munition 33.

Figure 3:
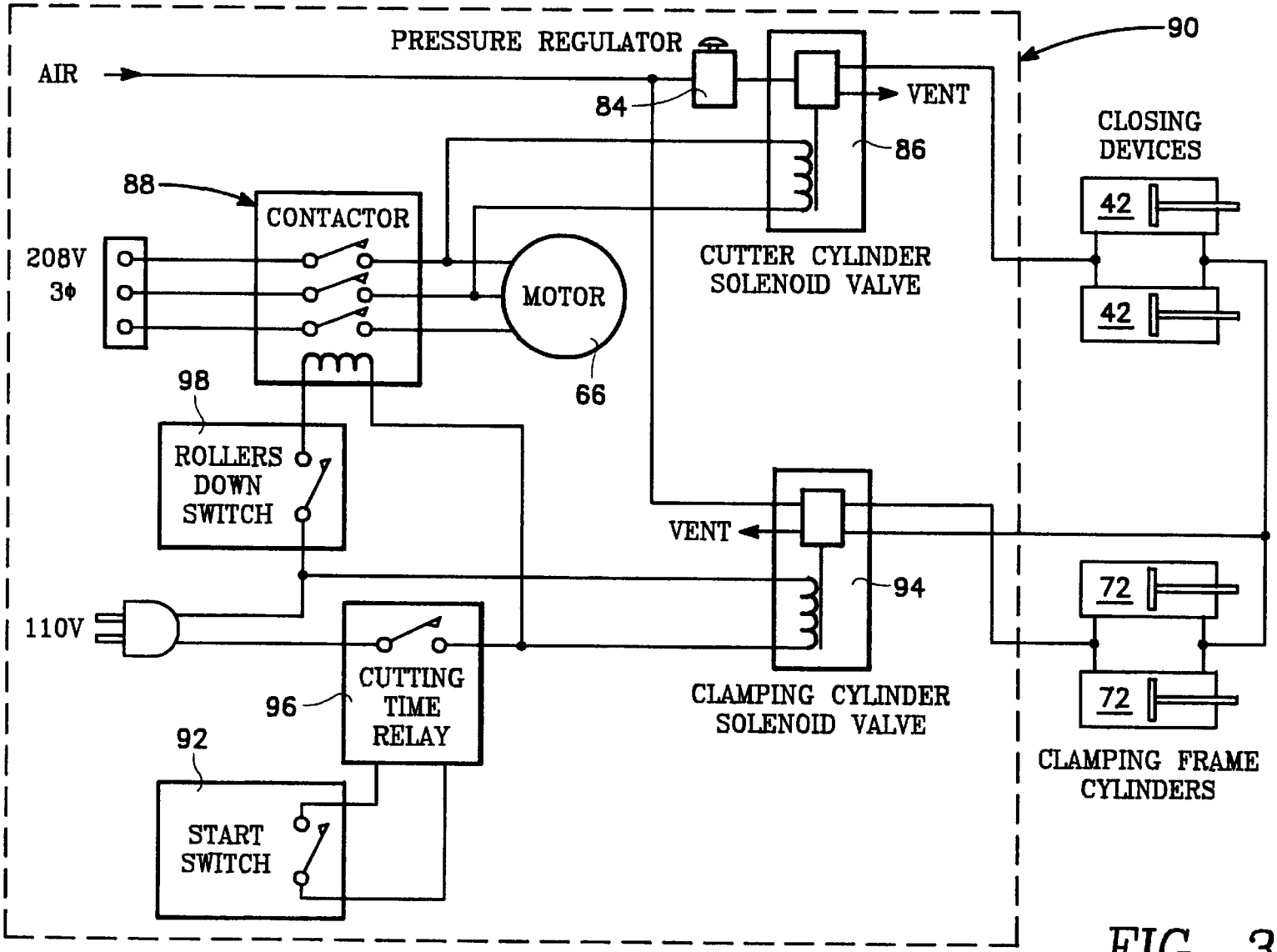
Figure 4A:
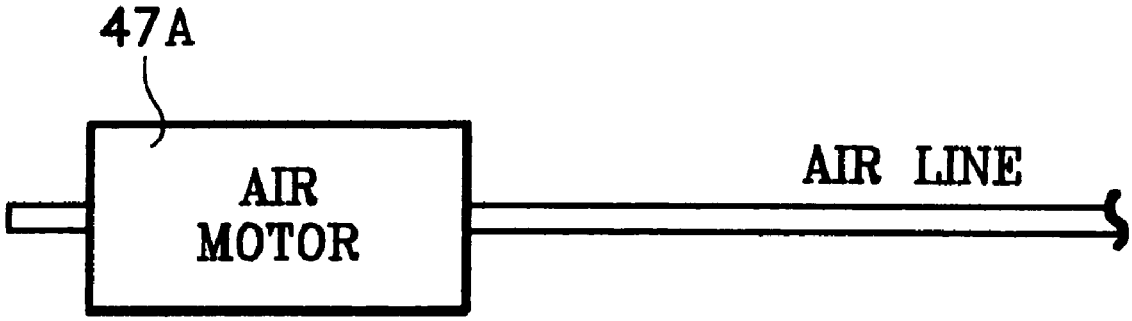
FIGS. 4A and 4B depict the use of hydraulic and air motors in preferred alternatives.
Figure 4B:
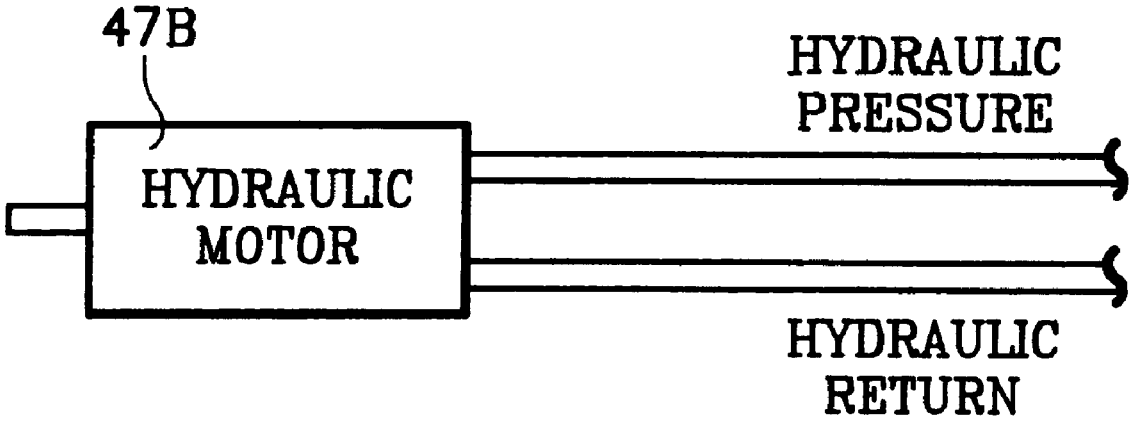

FIG. 3 shows the preferred embodiment for an electrical mechanism for the present invention as shown in FIG. 1 to be automated. Control of the automatic sequence of the case cutting device 10 may be carried out through a control panel 90 preferably located away and compartmented from any area housing the case cutting device 10. The control panel 90 is capable of actuation of the case cutting device 10 from this remote and safe location. In a preferred embodiment, the automated case cutting device 10 defaults in a retracted or open position 64. In alternative embodiments, the control panel 90 may comprise pneumatic, hydraulic, or other like control mechanisms.

In operation of the preferred embodiment, munitions 33 are disassembled by loading an uncut munition 33 onto the case cutting device 10 while the second frame member 22 is in an open position 64, guiding the munition 33 onto the first 14 and second 16 horizontally level roller shafts having a plurality of roller coverings 20, cradling the munition 33 on the first 14 and second 16 roller shafts, fixing the munition 33 in a longitudinal position with the first end pad 30, securing the munition 33 in the fixed longitudinal position with the second end pad 32 and vertically securing or clamping the munition 33 in the cradled position with the third 24 and fourth 26 roller shafts by placing the second frame member 22 into a closed position 62 in relation to the first frame member 12. The securing of the munition 33 is accomplished by tripping a start switch 92 from a remote position. The tripped start switch 92 actuates a cutting time relay 96 which applies 110 volts AC to a clamping cylinder solenoid valve 94. The clamping cylinder solenoid valve 94 applies air to the pneumatic clamping cylinder 72 to pneumatically force and extend the piston rod 74. The extending piston rod 74 forces the second frame member 22 to the closed position 62. The closing second frame member 22 clamps the munition firmly between the lower first 14 and second 16 roller shafts, and the upper third 24 and fourth 26 roller shafts. Setable stops (not separately shown) are used to limit and control the clamping force of the second frame member 22. Electrical power is initiated with a rollers down switch 98 that actuates a motor contactor 88. The motor contactor 88 actuates the motor 66 which drives a gear reducer input shaft (not separately shown) at 1750 rpm causing the gear reducer output shaft (not separately shown) to rotate at 20 rpm. A misalignment coupling 67 connecting the gear reducer to the first roller shaft 14 causes it to also rotate at 20 rpm. The lower chain and sprocket drive set 80, connecting the first 14 and second 16 roller shafts, causes the second roller shaft 16 to rotate at 20 rpm. The upper chain and sprocket drive set 82, connecting the first 14, third 24 and fourth 26 roller shaft, causes the third 24 and fourth 26 roller shafts to rotate at 20 rpm. Roller coverings 20 frictionally contact with the munition 33 causing the munition 33 to rotate at 10 rpm, when the munition 33 diameter is twice that of the roller shafts 14, 16, 24, 26. Generally, a munition 33 acquires full rotational speed within from about 0.5 seconds to 1 second.

Simultaneously, contactor 88 closure actuates a cutter cylinder solenoid valve 86, which allows low pressure air from the pressure regulator 84 to pass through an open cutter cylinder solenoid valve 86 to the cut side of the cutter cylinders 42 causing the cutting wheel 46 and flat wheel 58 to be brought into contact with the munition 33 exterior. The opposing cutter wheel 46 and flat wheel 58 sever the munition's outer case as the munition is rotated, with the cutting time is controlled by the cutting time relay 96. The relay 96 is set to a period of sufficient duration to assure completion of the cuts through the case of the munition 33. When the means for cutting 40 is activated, the cutting wheel 46 engages the munition 33 typically within a time period of from about 30 seconds to about 2 minutes, more typically from about 45 seconds to about 1½ minutes, and most typically from about 10 seconds to about 15 seconds. The cutting process may take approximately from about 30 seconds to about 5 minutes, with times of from about 1 minute to about 3 minutes desirable, and times of from about 1 minute to about 2 minutes more desirable.

When the cutting time relay times out, it opens removing the 110 volt AC controlling voltage from the contactor 88, allowing the contactor 88 to open. Contactor 88 opening removes the 208 volt AC power from the cutter cylinder solenoid valve 86, returning it to the normally closed position. The 208 volt AC power also is removed from powering the motor 66, stopping the rotation of the munition 33. Additionally, when the cutting time relay 96 times out, power is removed from the clamping cylinder solenoid valve 94, returning it to the normally closed position. Removal of power from the clamping solenoid valve 94 vents air from the system through cylinder extend ports (not separately shown) and applies pressure to all retract ports (not separately shown). This causes the pneumatic clamping cylinder 72 to pneumatically retract the piston rod 74, causing the second frame member 22 to swing open. The third 24 and fourth 26 roller shafts are thereby removed from contact with the munition cradled between the first 14 and second 16 roller shafts. The cutter wheel 46 and flat wheel 58 have also been retracted away from the munition 33 by this time. Roller 14, 16, 24, 26 and wheel 46, 58 retraction, in combination with the removal of rotational movement, provide access to the severed munition 33 for removal from the first frame member 12. Once removed, another munition 33 is placed in the first frame member 12 and the cutting and rotating process is repeated.

Cutting or sectionalizing the munition 33 should occur in areas between the inherent munition 33 sections. Accordingly, the cuts should occur between the propellant section (not separately shown) and the control section (not separately shown) of the munition 33, between the warhead section (not separately shown) and the control section, or between the propellant section and the warhead section, when applicable. As types of munitions are built the same, cutting the same location on each individual unit of a type of munition will similarly sectionalize all units. With the munition 33 being sectionalized, each section (not separately shown), during and after cutting, is independently supported in the cradle formed by the first 14 and second 16 roller shafts so that with the completion of cutting, none of the sections "fall". After the munition 33 has been sectionalized, it may be disposed of properly.

As described above, the case cutting device 10 of the present invention may further contain components that aid in the cutting of the munition 33, including optical sensors, hydraulic lifts, measuring devices, levers, and the like (not separately shown), particularly useful in fixing the munition 33 in the case cutting device 10, securing the munition 33, rotating the munition 33, cutting the munition 33, and/or removing the sectionalized munition (not separately shown) from the case cutting device 10. A control box 90 for the present invention may contain such parts as a weather proof metal box 84, pressure regulator, pneumatic clamping cylinder solenoid valve 94, cutter cylinder solenoid valve 86, cutting time relay 96, electrical contactor 88, momentary on switch (not separately shown), fuses and/or circuit breakers (not separately shown), and the required electrical/pneumatic connectors (not separately shown). Cutting means 40 may be physically set or programmed to perform the same cut on units of a given type of munition 33.

With the case cutting device 10 of the present invention, faster disassembly of munitions can occur, with increased safety. The design of the case cutting device 10 minimizes the amount of operator training required. Efficiencies also occur in the analysis of munitions, such as evaluating a misfire. In addition, similar munitions will be cut uniformly aiding in proper disposal.

The foregoing summary, description and drawings of the invention are not intended to be limiting, but are only exemplary of the inventive features which are defined in the claims.

What is claimed is:

1. A device for cutting a case around the case's perimeter, the perimeter being generally normal to a longitudinal axis of the case, the case having first and second ends along its longitudinal axis and, in at least one configuration, protrusions from said perimeter, comprising:

a first frame member and a second frame member, said first frame member being fixed in a stationary position having said second frame member movably connected thereto sufficient to permit an open and closed position of said second frame member in its relation to said first frame member;

first and second roller shafts, each said first and second roller shafts having a longitudinal axis and a top and a bottom relative to each said first and second roller shaft's static position in said cutting device, said first and second roller shafts rotationally attached to said first frame member in a side-by-side configuration at a distance less than the width of the case;

at least a third roller shaft, having a longitudinal axis and a top and bottom relative to said third roller shaft's static position in said cutting device, rotationally attached to said second frame member located above and between said first and second roller shafts when said first and second roller shafts are in the closed position relative to said third roller shaft, wherein said third roller shaft vertically secures the case on top of and between said first and second roller shafts;

at least one roller covering circumferentially attached to each of said first, second and third roller shafts and positioned in relation to each other, said at least one roller covering for supporting and securing the case on top of and between said first and second roller shafts, wherein the case may be rotated about the case's longitudinal axis;

a first end pad, operably attached to said first frame member, for engaging said first end of the case and fixing the longitudinal positioning of the case on said at least one roller covering affixed to each of said first, second, and third roller shafts, and a second end pad, operably attached to said first frame member, for engaging said second end of the case and securing the case in a fixed position with respect to the case's longitudinal axis;

means, operably attached to said first frame member, for cutting the case normal to the case's longitudinal axis and effective to sever the case into multiple sections; and, means, operably attached to said first frame member and at least said first roller shaft, for rotating the case about the case's longitudinal axis while said case is on top of and between said first and second roller shafts.

2. The case cutting device of claim 1, wherein each of said first and second roller shafts are supported on vertical extensions supported by said first frame member.

3. The case cutting device of claim 1, wherein said case encloses a munition.

4. The case cutting device of claim 1, further comprising at least a fourth roller shaft, having a longitudinal axis and a top and bottom relative to said fourth roller shaft's static position in said cutting device and operably attached to said second frame member, for aiding in securing the case.

5. The case cutting device of claim 4, wherein said fourth roller shaft is operably attached to and supported by said second frame member.

6. The case cutting device of claim 1, wherein each of said at least one roller covering is distributed in a pre-specified manner along the longitudinal axis of each said roller shaft.

7. The case cutting device of claim 6, wherein each of said at least one roller coverings is spaced along said longitudinal axis of each said roller shaft to permit rotation of cases having external protrusions from the longitudinal axis of the cases.

8. The case cutting device of claim 1, wherein the means for cutting comprises a blade.

9. The case cutting device of claim 8, wherein said blade is selected from the group consisting of cutting wheels and straight knife-bladed assemblies.

10. The case cutting device of claim 8, wherein said means for cutting further comprises a means for powering a blade, said means of powering selected from the group consisting of an air motor and a hydraulic motor.

11. The case cutting device of claim 1, wherein said means for cutting may adjust to various cutting depths for cutting the case.

12. The case cutting device of claim 4, wherein said means for rotating comprises a first drive chain driven on at least one first sprocket operably connected between said first and second roller shafts.

13. The case cutting device of claim 12, wherein said means for rotating further comprises a second drive chain driven on at least one second sprocket operably connected to said first, third and fourth roller shafts.

14. The case cutting device of claim 1, wherein said first and second end pads may rotate with the rotation of the case.

15. The case cutting device of claim 1, wherein the case cutting device is at least partially automated.

16. The case cutting device of claim 15, wherein said at least partially automated case cutting device may be actuated from a remote location.

17. A method for cutting a case around the case's perimeter, the perimeter being normal to a longitudinal axis of the case, the case having first and second ends along its longitudinal axis and, in at least one alternative configuration, protrusions from said perimeter, comprising:

providing a case cutting device comprising:

a first frame member and a second frame member, said first frame member being fixed in a stationary position having said second frame member movably connected thereto sufficient to permit an open and closed position of said second frame member in relation to said first frame member, first and second roller shafts, each said first and second roller shafts having a longitudinal axis and a top and bottom relative to each of said first and second roller shafts' static position in said cutting device, said first and second roller shafts rotationally attached to the first frame member in a side-by-side configuration at a distance less than the width of the case, at least a third roller shaft, having a longitudinal axis and a top and bottom relative to said third roller shaft's static position in said cutting device and rotationally attached to said second frame member located above and between said first and second roller shafts when in the closed position, wherein said third roller shaft secures the case from vertical movement at said top of said cutting device at said third roller shaft's position above and between said first and second roller shafts, at least one roller covering circumferentially attached to each of said first, second and third roller shafts and said at least one roller coverings positioned in relation to each other for supporting and securing the case on top of and between said first and second roller shafts, wherein the case may be rotated, a first end pad, operably attached to said first frame member, for engaging a first end of the case and fixing the positioning of the case along the case's longitudinal axis on said at least one roller covering on each of said first, second and third roller shafts, a second end pad, operably attached to said first frame member, for engaging said second end of the case and securing the case in a fixed position with respect to the case's longitudinal axis, means for cutting the case, operably attached to said first frame member and effective to sever sections of the case in a direction normal to the case's longitudinal axis, and means, operably attached to said first frame member, for rotating the case on top of and between said first and second roller shafts;

placing a case on top of and between said first and second roller shafts; securing the case from vertical movement by fixing at least said third roller shaft on said top of the case;

engaging said means for cutting with the case; and, activating said means for rotating the case, said means for rotating operably attached to said first roller shaft, wherein the case is rotated and severed about the case's said perimeter in at least one location along the case's longitudinal axis.

18. The method of claim 17, wherein engaging said means for cutting and activating said means for rotating the case is done at least partially automatically, wherein said case encloses a munition.

19. The method of claim 18, wherein engaging said means for cutting and activating said means for rotating the case are done simultaneously.

20. The method of claim 18, further comprising releasing the case after the case has been cut through the case's perimeter normal to the case's longitudinal axis in at least one location.

* * * * *